US011897717B2

(12) United States Patent
Barel et al.

(10) Patent No.: US 11,897,717 B2
(45) Date of Patent: Feb. 13, 2024

(54) APPARATUS AND METHOD FOR PALLET TRANSFER

(71) Applicant: Hewlett-Packard Development Company, L.P., Spring, TX (US)

(72) Inventors: Assaf Barel, Ness Ziona (IL); David Mazar, Ness Ziona (IL); Dudi Gutman, Ness Ziona (IL); Boaz Eden, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 87 days.

(21) Appl. No.: 17/415,285

(22) PCT Filed: Jul. 26, 2019

(86) PCT No.: PCT/US2019/043705
§ 371 (c)(1),
(2) Date: Jun. 17, 2021

(87) PCT Pub. No.: WO2021/021086
PCT Pub. Date: Feb. 4, 2021

(65) Prior Publication Data
US 2022/0144575 A1 May 12, 2022

(51) Int. Cl.
*B65H 31/30* (2006.01)

(52) U.S. Cl.
CPC ..... *B65H 31/3063* (2013.01); *B65H 2301/42256* (2013.01); *B65H 2403/41* (2013.01); *B65H 2801/21* (2013.01)

(58) Field of Classification Search
CPC .... B65H 31/3063; B65H 31/30; B65H 31/32; B65H 2301/42256; B65H 2403/41; B65H 2801/21
See application file for complete search history.

(56) References Cited

U.S. PATENT DOCUMENTS

| | | | | |
|---|---|---|---|---|
| 3,178,053 A | | 4/1965 | Robinson | |
| 4,088,237 A | | 5/1978 | Brown | |
| 4,111,411 A | * | 9/1978 | Graves | B65H 31/30 198/577 |
| 4,421,028 A | * | 12/1983 | Pollich | B65H 31/32 271/189 |
| 5,011,126 A | | 4/1991 | Suzuki et al. | |
| 5,235,907 A | | 8/1993 | Hirata | |
| 5,375,967 A | | 12/1994 | Rathert | |
| 5,520,504 A | | 5/1996 | Zahn | |

(Continued)

FOREIGN PATENT DOCUMENTS

| | | |
|---|---|---|
| CN | 108082905 A | 5/2018 |
| JP | H01313258 A | 12/1989 |
| KR | 101693596 B1 | 1/2017 |

*Primary Examiner* — Thomas A Morrison

(57) ABSTRACT

An apparatus is disclosed comprising first and second pallet supports to engage pallets in at least a first and a second pallet location. The first pallet location positions a pallet to receive output from a print press. The second pallet location is a pre-use pallet holding location. The apparatus further comprises an actuator to move the first and second pallet supports to transfer a first pallet away from the first pallet location and a second pallet from the second pallet holding location to the first pallet location. A method of transferring pallets is also disclosed.

8 Claims, 5 Drawing Sheets

(56) References Cited

U.S. PATENT DOCUMENTS

| | | | | |
|---|---|---|---|---|
| 5,628,505 | A * | 5/1997 | Voss | B65H 31/32 271/189 |
| 5,669,755 | A * | 9/1997 | Zahn | B65H 31/30 414/789.5 |
| 5,672,045 | A * | 9/1997 | Schmid | B65H 31/10 414/794.3 |
| 2004/0240979 | A1 | 12/2004 | Beavers et al. | |
| 2011/0014021 | A1 * | 1/2011 | Reid | B65H 31/30 414/389 |
| 2012/0288354 | A1 * | 11/2012 | Moore | B65H 31/3063 414/800 |
| 2014/0110221 | A1 | 4/2014 | Deflandre | |
| 2018/0111762 | A1 | 4/2018 | Baek | |

* cited by examiner

APPARATUS AND METHOD FOR PALLET TRANSFER

BACKGROUND

Print presses are often used to print relatively high volume runs of print runs. Increasingly digital print presses are used for such tasks (replacing for example offset print presses). In order to optimize the cost of prints from print presses in commercial use it is desirable to minimize downtime and increase the utilization of the press.

Depending upon the application print presses can be arranged to utilize print media which is either in a web-feed format or in a sheet-feed format. Presses for sheet-fed media may include a stacker arranged inline with the press to receive print output and accumulate a stack of printed media. Once a stack is completed it is removed from the printer to allow subsequent printing to continue.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1A:
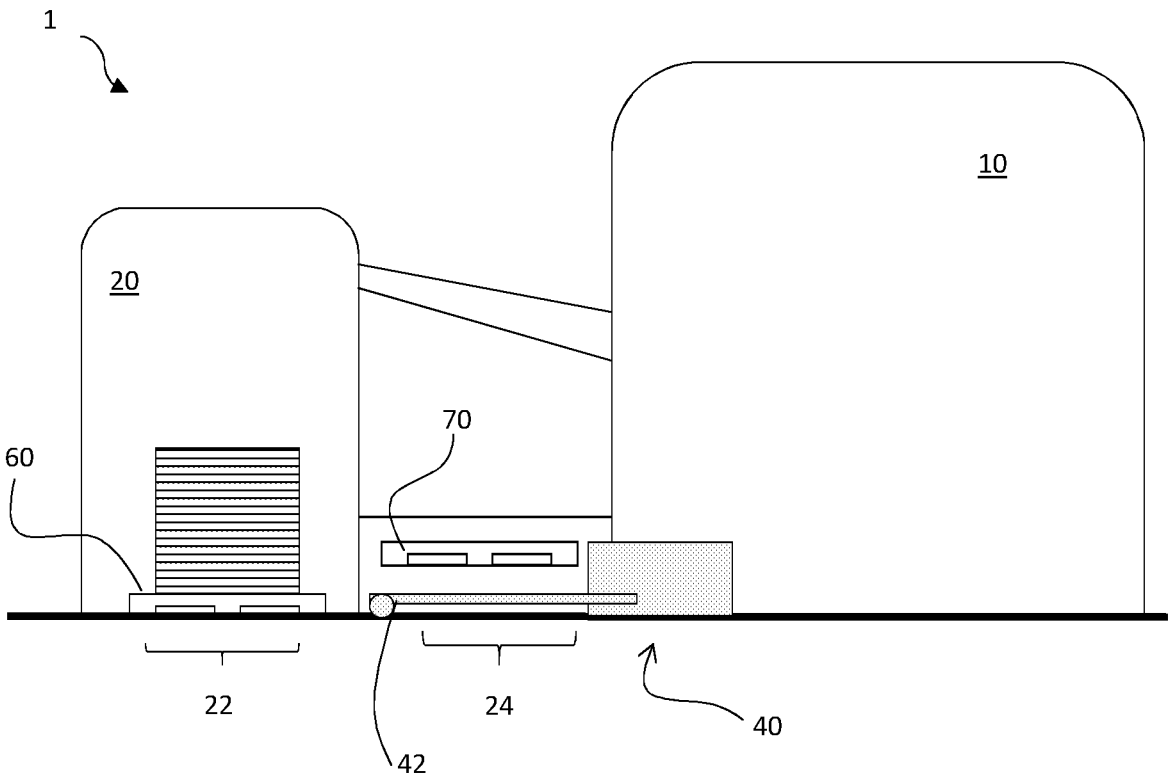
FIG. 1A to FIG. 1E show a schematic example of a print press and stacker including an implementation of the present disclosure in a series of operational states.
Figure 1B:
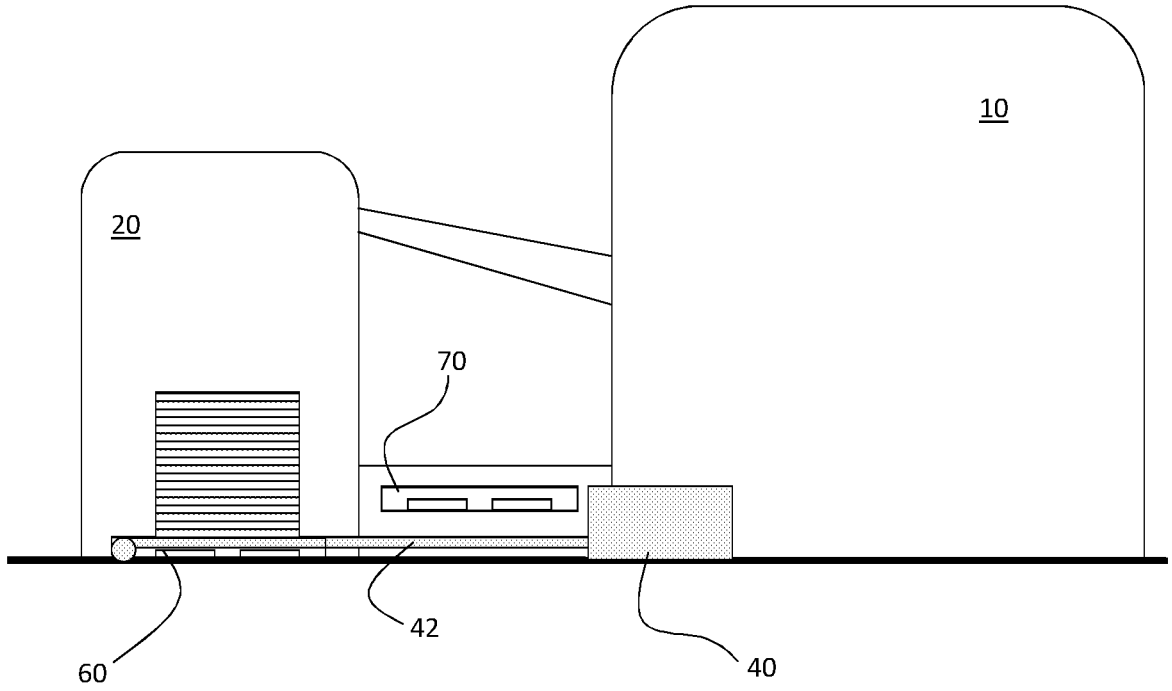

An apparatus is shown in FIGS. 1A to 1E and 2, for handling print press output, for example sheet output from a print press 1. The apparatus may be a print press bulk output handling apparatus, for example a sheet print press bulk output handling apparatus. In particular, the apparatus 40 can assist in the efficient handling of sheet output accumulated on pallets 60, 70 by a stacker 20 which is connected inline with the output of the print engine 10 of the press 1. The apparatus 40 according to the disclosure includes both a first pallet support 44 and a second pallet support 46 to engage pallets 60, 70 in at least a first pallet location 22 and a second pallet location 24. The first pallet location 22 corresponds to a position in which a pallet can receive output from the print press 1. For example, the first pallet location 22 may be directly below an inline stacker 20 of the press 1 (for example the pallet location 22 may be aligned with an elevator of the stacker 20). The second pallet location 24 may be a pre-use pallet holding location. As such a pallet 70 may be held in a ready state in the second pallet location 24.

The apparatus may further include an actuator 40 to move the first 44 and second 46 pallet supports. As will be explained further below, the movement of the pallet supports 44, 46 may transfer a first pallet 60 away from the first pallet location 22 and a second pallet 70 from the second pallet holding location 24 to the first pallet location 22. The first pallet 60 may, for example be moved away from the first pallet location 22 to a location external to the print press 1 for ease of removal of the completed print output.

The first pallet support 44 may be movable between the first pallet location 22 and the exterior of the print press 1. The second pallet support 46 may be movable between the first pallet location 22 and the second pallet location 24. In such an arrangement the pallet supports can effectively provide a dedicated loaded pallet support (the first pallet support 44) and empty pallet support (the second pallet support 46).

The movement of the first 44 and second 46 pallet supports may be concurrent. For example, the movement may be synchronized and/or may be simultaneous. As the apparatus of this disclosure both removes a completed pallet (which it will be appreciated may be a full pallet or a partially full pallet depending upon the point in a print run) and positions a new pallet it may be possible to reduce the time period for which the print press is paused.

Examples of the present disclosure can increase utilization of the printing press 1 by reducing the time for which the press might be paused during any pallet change over. In existing print presses the change over of pallets may, for example, involve the press output being paused for one to two minutes whist an operator removes a full pallet from the output position of the press and subsequently positions a new empty pallet in the output position. This may for example need to be repeated between 1 to 3 times per hour. As such this may represent significant total press downtime (for example as much as 15%) and may for example be further impacted dependent upon availability of the press operator (who may have other tasks such as consumables replacement & paper loading to attend to). In examples based upon the present disclosure the operator may ensure that a pallet is in the pre-use pallet holding location whilst the press is in use and any pause in the press output may merely correspond to the short time period during which the apparatus of an example is physically switching the pallet locations. Once the full pallet is moved away from the output position the operator may remove the pallet at a convenient time whilst the press has resumed output to the second pallet (which will then be in the output location).

Figure 2:
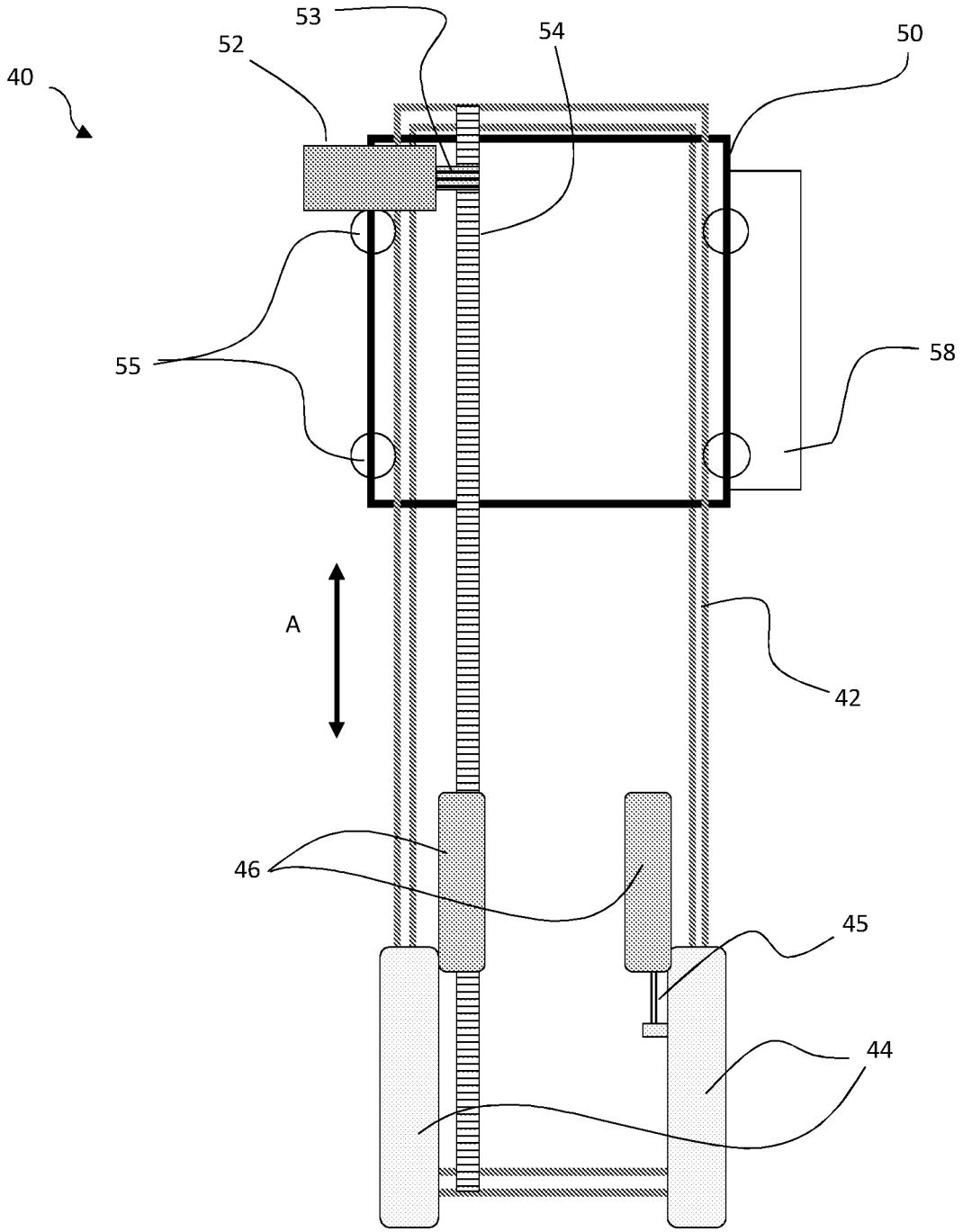
FIG. 2 shows a schematic plan view of an example apparatus in accordance with the present disclosure.

The configuration of an apparatus suitable for implementing this disclosure is best seen in FIG. 2. It may be appreciated that the apparatus could be provided integral to the press 1 or the stacker 20. Additionally, or alternatively the apparatus may be a generally self-contained device such that it may for example be added to an existing in situ press 1. The apparatus includes a frame 50 which can be fixed relative to the output of the print press 1. The frame 50 may support the actuator 40. In some examples the frame 50 could be integral with the press engine 10 or stacker 20. The actuator 40 includes a chassis 42 which can be linearly slidable relative to the frame 50. A set of guide rollers 55 may be positioned between the frame 50 and chassis 42 and may for example be adjustable to ensure correct alignment therebetween. One or both of the frame 42 and/or the chassis 55 can also be provided with bearings over which the chassis 42 may slide and which may be load bearing with respect to the pallet supports 44 and 46.

The actuator 40 can provide relative linear movement between the chassis 42 and the frame 50 as indicated by arrow A in FIG. 2. As such, the actuator can translate the first and second pallet supports along a linear path. Conveniently, in the example the linear movement axis of the apparatus is in line with the processing direction of the press 1. The actuator 40 may for example be powered by a motor 52 and may move a pinion gear 53 which engages a rack 54. Additional rack and pinion arrangements could be provided in some examples. For example, a further slave rack and pinion could be provided to stabilize movement of the apparatus.

The chassis 42 carries both the first pallet support 44, which in this example may be considered the "loaded pallet support" and the second pallet support 46, which in this example may be considered the "empty pallet support". The pallet supports 44, 46 may be in the form of a pair of support beams. The support beams 44 and 46 may be spaced apart in the direction transverse to the linear movement direction of the actuator. It may be noted that in the example, the support beams 44 and 46 have different widths. One support beam pair may have an outer width which is less than the inner spacing of the other support beam pair. Such an arrangement may provide support beams 44 and 46 which are at least partially nestable in the linear movement direction. In the example, the empty pallet support 46 is narrower than the loaded pallet support 44 and may therefore nest or overlap with the loaded pallet support 44 in the linear movement direction. At least one of the pallet supports 44, 46 may be provided with a linearly movable connection to the chassis 42. For example, an adjustor 45 may be provided for positioning the pallet support (in this example the empty pallet support 46) relative to the chassis 42. Thus, the relative positions of the pallet supports 44 and 46 may be adjustable.

In the example of FIG. 2, the chassis 42 is of a fixed size and slides relative to the frame 50 to move the pallet supports 44, 46. Alternatively, for example when the print press 1 provides space constraints on the actuator 40, some arrangements may include a chassis 42 with at least one telescopic element such that the chassis 42 extends to position the pallet supports. Such extension of the chassis 42 may be an alternative to or in addition to sliding movement (with the resulting movement of either arrangement being the pallet supports 44, 46 undergoing a linear translation relative to the print press 1).

The actuator 40 may also include a lifting mechanism 49 (in FIG. 1C) to raise and lower the pallet supports 44 and 46. It will be appreciated that the lifting mechanism could be a common lifting mechanism for the actuator 40 (for example to move the chassis 42 relative to the frame 50) or dedicated lifting mechanisms could be provided for each pallet support 44, 46. The lifting mechanism 49 enables the pallet supports 44, 46 to be raised from the floor to enable movement.

The operating sequence of the apparatus 40 will be described with particular reference to FIGS. 1A to 1E. The initial configuration shown in FIG. 1A may be considered the default condition of the print press 1 during a print run. A first pallet 60 is in the output location 22 and is accumulating print output from the stacker 20 (which is in turn receiving output from the print engine 10). A second pallet 70 is positioned in the pre use or buffer location 24. The chassis 42 of the actuator 40 may be in a retracted position.

As the first pallet 60 reaches a completed state (which could either be due to the pallet being full or the intended quantity of print output having been accumulated) the actuator 40 of the apparatus may be activated to extend the chassis 42 in the linear direction. Thus, the chassis 42 extends or moves so as to underly both the output location 22 and the pre-use location 24. In this position the first pallet support 44 is aligned with the first pallet 60 and the second pallet support 46 is aligned with the second pallet 70. Once the pallet supports are in position the print output from the print press 1 may be paused.

Figure 1C:
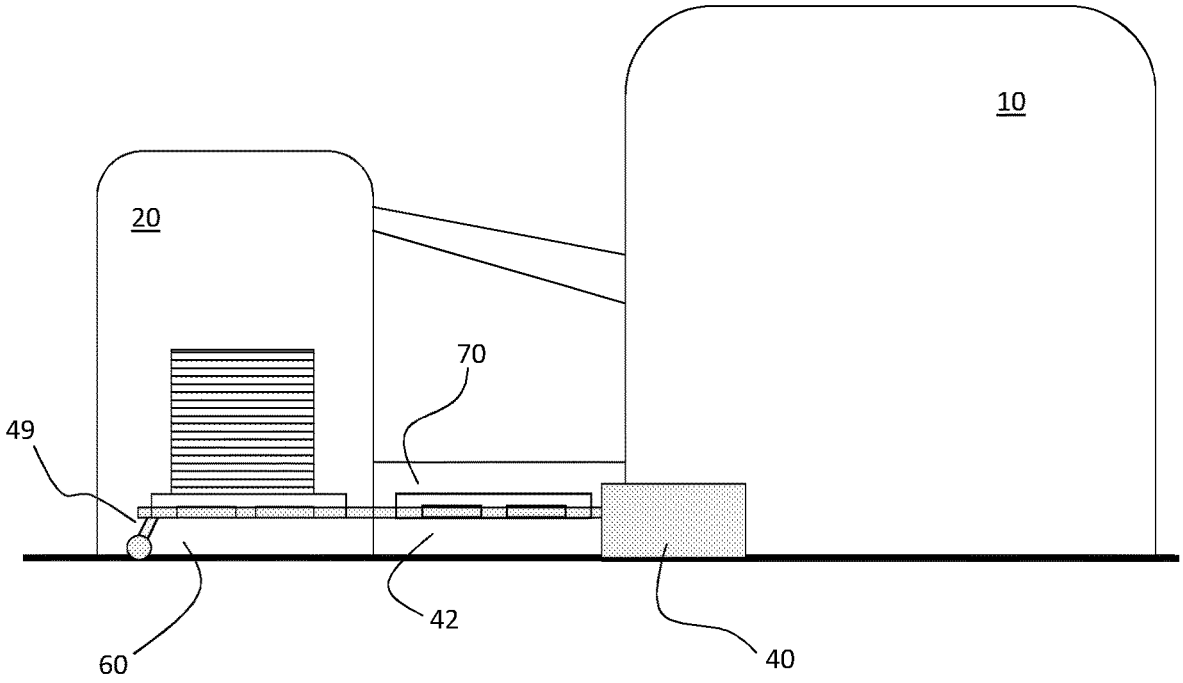
Figure 1D:
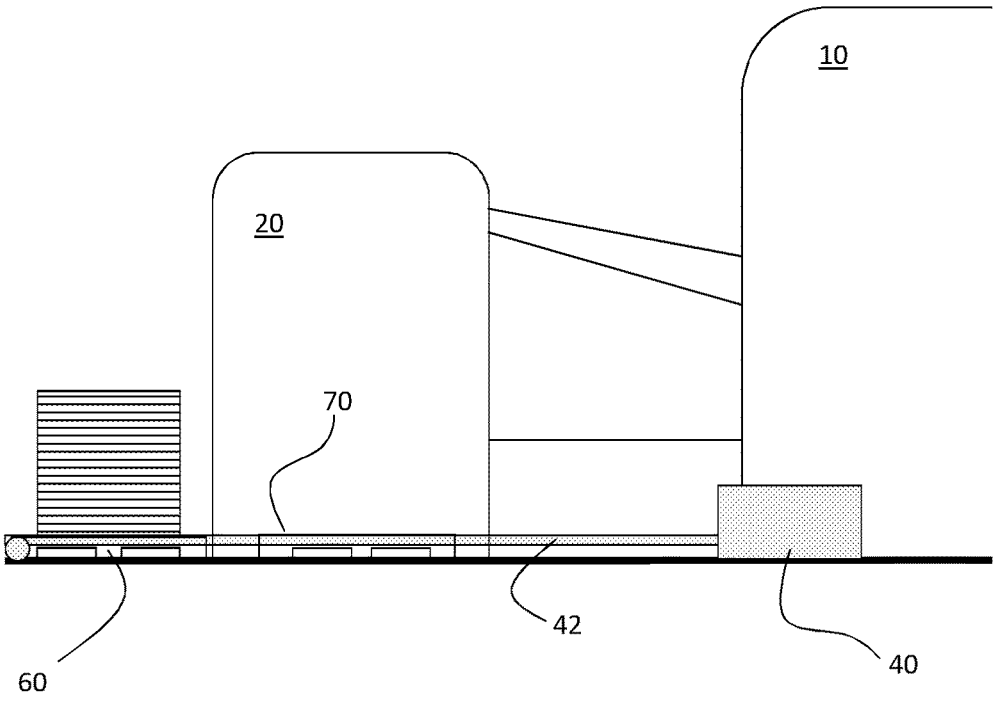
Figure 1E:
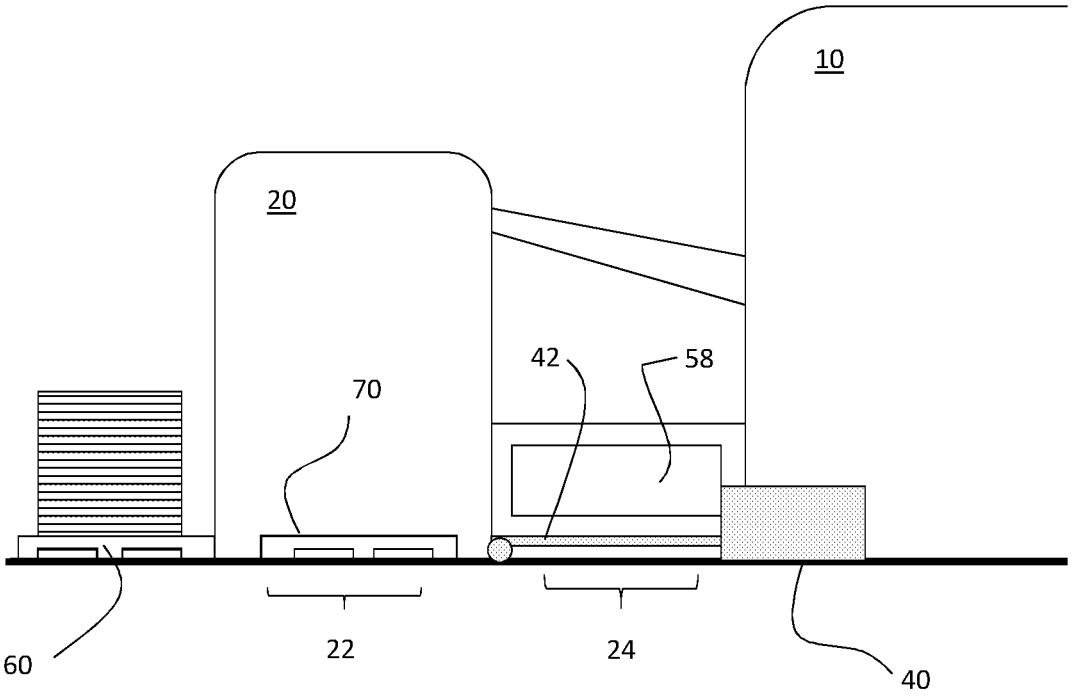

The actuator 42 can subsequently be raised, as shown in FIG. 1C, by the lifting mechanism 49. Thus, the first 60 and second pallets 70 can be supported clear of the floor on their respective pallet supports 44, 46. The actuator can then continue to extend or translate the chassis 42, towards the position shown in FIG. 1D. As a result, the full pallet 60 can be positioned outside of the print press 1 and the empty pallet 70 can be placed into the output location 22. In the example shown the movement of the pallet supports 44, 46 can be a parallel movement so as to reduce the time taken for the pallets 60 and 70 to be exchanged. The lifting mechanism 49 may then lower the pallets to be supported upon the floor.

At this stage output from the print press 1 may resume and can be accumulated on the new pallet 70. The actuator may then retract back towards the print press 1. As the lifting mechanism 49 is lowered the retraction of the chassis 42 will leave the full pallet 60 outside of the print press 1 (from where it may be removed without interruption to the print process) and the new pallet in the output position 22. A further pallet may then be introduced into the apparatus in the pre-use location 24 ready for the process to be repeated. To aid loading of the buffer pallet without interruption to the print process a door 58 may be provided alongside the pre-use location 24. For example, the door 58 may be positioned to allow a pallet to be side-loaded relative to the print press 1, for example being slid into position in a direction transverse to the movement axis of the actuator 40.

Although the example above uses the first pallet support 44 as a "loaded pallet support" and the second pallet support 46 as an "empty pallet support", other arrangements may be used in other implementations. For example, one pallet support could remain with a pallet throughout the process. For example, the same pallet support could move the pallet first from the pre-use location to the output location and then subsequently move the same pallet from the output location to the exterior of the press. In such a configuration the second pallet support could move from the external location to the pre-use location as the first support moved from the in-use position to the external location.

Figure 3:
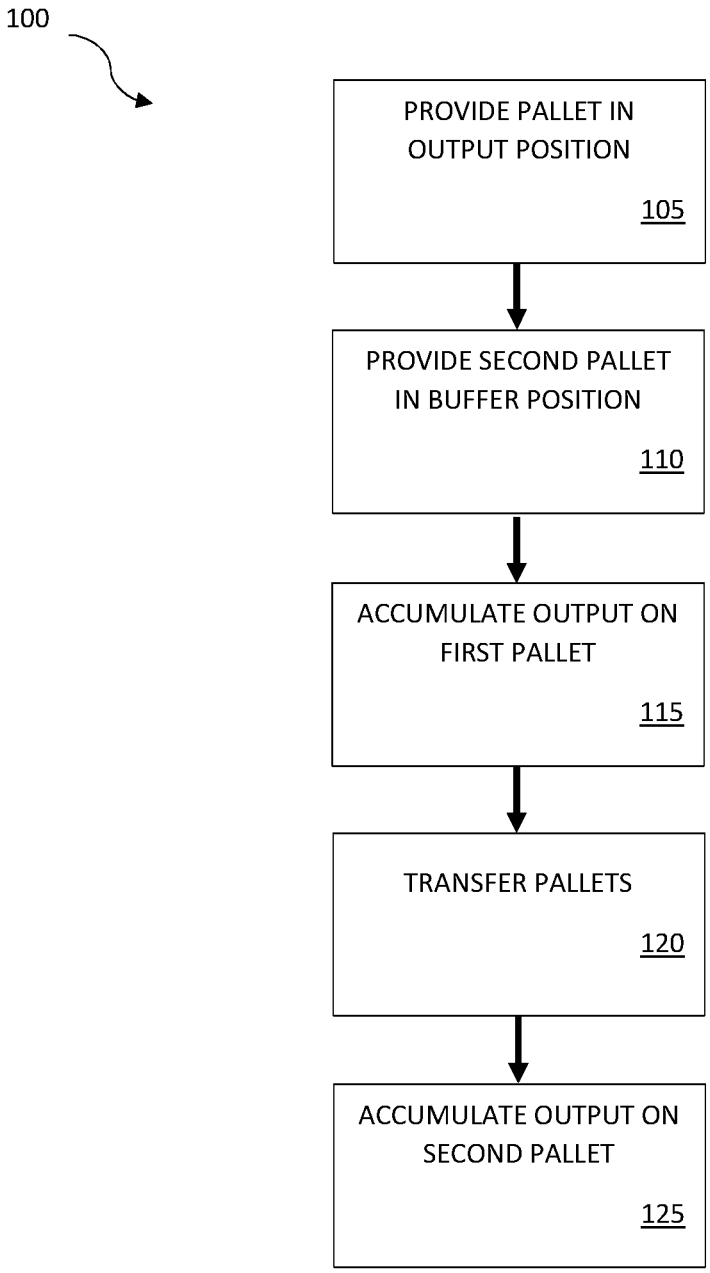
FIG. 3 is a flow chart showing a method in accordance with an example.

Examples of the disclosure may further include methods of operating a print press as illustrated in the example flow chart 100 of FIG. 3. The method may be a method of bulk handling sheet print press output. In block 105 of the method a first pallet may be provided in an output position to receive output from a print press. In block 110 a second pallet may be provided in a buffer position. In block 115, output from the print press is accumulated on the first pallet. In block 120, the first pallet can be transferred away from the output position. The second pallet can also be transferred in block 120 from the holding position to the output position. The transfer of the pallets in block 120 may be concurrent movement. In block 125 printing may continue with output accumulated on the second pallet. Transferring the pallets concurrently (for example in a simultaneous movement) may for example reduce the time for which the print output need be paused to change the pallets. As such implementations of the disclosure may enable increased print press utilization.

The output position can be associated with an elevator of a print press stacker. The method may include the stacking sheet print output on the first pallet in block 110. Sheet print output may be stacked on the second pallet in block 125.

When the output is accumulated on the second pallet in block 125, a further pallet may be provided in the buffer position when the second pallet is in the output position.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. An apparatus comprising:

first and second pallet supports to engage pallets in at least first and second pallet locations, wherein:

the first pallet location positions a pallet to receive output from a print press, and the second pallet location is a pre-use pallet holding location; the apparatus further comprising an actuator to move the first and second pallet supports to transfer a first pallet away from the first pallet location and a second pallet from the second pallet location to the first pallet location, wherein the actuator comprises a frame and a linearly translating chassis, the chassis supporting the first and second pallet supports, wherein the actuator translates the first and second pallet supports along a linear path, wherein the first pallet support and the second pallet support each comprise a pair of support beams, each pair of support beams being spaced apart in a direction transverse to a linear movement direction of the actuator, and wherein the first pallet support and the second pallet support are at least partially nestable.

2. An apparatus as claimed in claim 1, wherein the first pallet support is movable between the first pallet location and a position external to the apparatus.

3. An apparatus as claimed in claim 1, wherein the second pallet support is movable between the first pallet location and the second pallet location.

4. An apparatus as claimed in claim 1, wherein the actuator provides concurrent movement of the first and second pallet supports.

5. An apparatus as claimed in claim 1, wherein the actuator further comprises a rack associated with one of the chassis and the frame and a pinion associated with the other of the frame and the chassis.

6. An apparatus as claimed in claim 1, wherein the actuator further comprises a linearly movable connection between at least one of the first and second pallet supports and the chassis.

7. An apparatus as claimed in claim 1, wherein the actuator further comprises a lifting mechanism to raise and lower the first and second pallet supports for movement of the pallets.

8. A print press stacker comprising an apparatus as claimed in claim 1, further comprising an elevator to accumulate print output and wherein the first pallet location is below the elevator.

* * * * *